US008100321B2

(12) United States Patent
Ghini et al.

(10) Patent No.: US 8,100,321 B2
(45) Date of Patent: Jan. 24, 2012

(54) PACKET SERVING TO CONTAIN LOOSE ITEMS, AND A BLANK FROM WHICH TO FASHION SUCH A PACKET

(75) Inventors: Marco Ghini, Monte San Pietro (IT); Giuseppe Marcante, Vicenza (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 249 days.

(21) Appl. No.: 12/312,655

(22) PCT Filed: Nov. 19, 2007

(86) PCT No.: PCT/IB2007/003625

§ 371 (c)(1),
(2), (4) Date: May 20, 2009

(87) PCT Pub. No.: WO2008/062304

PCT Pub. Date: May 29, 2008

(65) Prior Publication Data

US 2010/0059581 A1 Mar. 11, 2010

(30) Foreign Application Priority Data

Nov. 22, 2006 (IT) ..... BO2006A0790

(51) Int. Cl.
*B65D 5/38* (2006.01)

(52) U.S. Cl. ..... 229/129.1; 229/125.125; 229/220

(58) Field of Classification Search ..... 229/125.125, 229/129.1, 220, 125.12, 185.1
See application file for complete search history.

(56) References Cited

U.S. PATENT DOCUMENTS

| | | | | | |
|---|---|---|---|---|---|
| 2,581,944 | A * | 1/1952 | Donnell | 229/125.125 |
| 2,990,994 | A * | 7/1961 | Hackmyer | 229/129.1 |
| 3,302,844 | A * | 2/1967 | Henry | 229/125.125 |
| 3,648,918 | A * | 3/1972 | Van Inwagen | 229/125.125 |
| 3,828,923 | A * | 8/1974 | Phillips, Jr. | 229/125.125 |
| 4,646,960 | A * | 3/1987 | Challand | 229/125.125 |
| 4,967,909 | A * | 11/1990 | McKibben | 229/125.125 |
| 6,168,073 | B1 * | 1/2001 | Towle | 229/125.125 |
| 6,955,290 | B2 * | 10/2005 | Wende | 229/129.1 |
| 7,090,079 | B2 * | 8/2006 | Ehrlund | 229/125.125 |
| 7,389,875 | B2 * | 6/2008 | Sandberg et al. | 229/125.125 |
| 2005/0029336 | A1 | 2/2005 | Wende | |

FOREIGN PATENT DOCUMENTS

| | | | | |
|---|---|---|---|---|
| DE | 203 02 162 | U1 | 7/2004 | |
| EP | 1 048 577 | A1 | 11/2000 | |
| GB | 2042476 | A * | 9/1980 | 229/125.125 |
| WO | WO 2006/131830 | A1 | 12/2006 | |

* cited by examiner

*Primary Examiner* — Gary Elkins
(74) *Attorney, Agent, or Firm* — Timothy J. Klima; Shuttleworth & Ingersoll, PLC

(57) ABSTRACT

A rigid packet for loose pastilles, sweets or similar items is composed of an outer casing (2), and an inner casing (3) with a small opening (4), accommodated slidably in the outer casing (2). The packet can assume a closed configuration in which the opening (4) is concealed completely by the outer casing (2), or an open configuration in which the opening (4) is at least partly exposed and is furnished with a mechanism (14) designed to lock the inner casing (3) in the closed position; the locking mechanism (14) can be operated from externally of the packet to release the inner casing (3) and allow it to slide toward the open position.

15 Claims, 3 Drawing Sheets

PACKET SERVING TO CONTAIN LOOSE ITEMS, AND A BLANK FROM WHICH TO FASHION SUCH A PACKET

This application is the National Phase of International Application PCT/IB2007/003625 filed Nov. 19, 2007 which designated the U.S. and that International Application was published under PCT Article 21(2) in English.

TECHNICAL FIELD

The present invention concerns a packet serving to contain loose items, and a blank from which to fashion such a packet.

The invention finds application, advantageously, in the art field relating to the packaging of pastilles and the like in wrappers designed to contain a given number of loose items, en masse.

In particular, the present invention relates to rigid packets of reclosable design, manufactured from cardboard, for example.

BACKGROUND ART

The prior art embraces packets of reclosable type consisting in a container of parallelepiped appearance that presents a bottom wall and four side walls, two larger and two smaller, paired and extending parallel to a predominating longitudinal axis. The packet is also furnished uppermost with a lid, hinged to the container at one end of one of the larger walls, and retained in the closed position by means of a tongue attached permanently to the selfsame container and designed to engage a lip presented by an inside face of the lid.

The products contained in such packets often cannot be dispensed satisfactorily, in particular small tablet-type items, given that with the lid in the open position, the size of the opening through which the contents are released is the same as the entire cross sectional area of the packet.

In addition, the lid impedes the passage of the contents when shaken out of the packet.

Finally, after the lid has been opened a given number of times, the tongue becomes no longer able to guarantee a firm closure of the lid, and the contents are liable to spill out.

Also embraced by the prior art are packets of the type disclosed in international patent application PCT/IB2006/001635, incorporated here by reference in its entirety, which comprise an outer casing and an inner casing, furnished with an opening, accommodated slidably in the outer casing and capable of sliding movement between an open position and a closed position.

Such packets also comprise stabilizing means located between the outer casing and the inner casing, by which the inner casing is held firm in each of the two positions mentioned above.

The conventional packets in question do not guarantee a sufficiently secure closure in the event of their containing medicinal pastilles, or indeed any other type of loose item, that could be harmful to children.

DISCLOSURE OF THE INVENTION

Accordingly, the object of the present invention is to provide a packet unaffected by the drawbacks mentioned above.

One object of the invention, in particular, is to provide a packet for loose items such as will allow the contents to be dispensed without difficulty when required, and at the same guarantee a secure closure.

Another object of the invention is to provide a diecut blank from which to erect the packet, without using complex and costly machinery for the purpose. The stated objects are duly realized in a packet serving to contain loose items, and a blank from which to fashion such a packet, as recited and characterized in one or more of the appended claims.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

Figure 1:
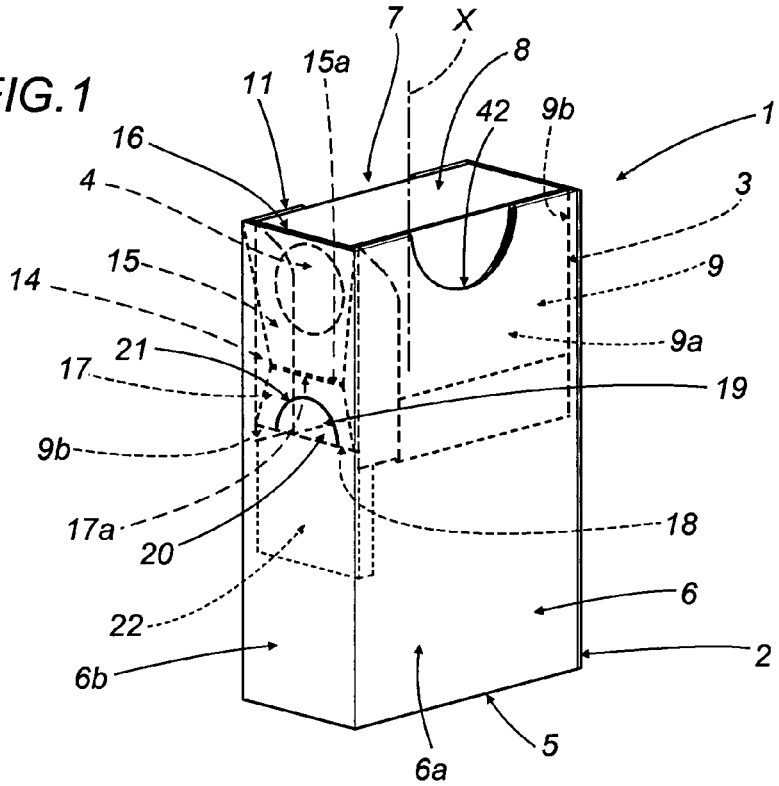
FIG. 1 shows a packet according to the present invention, illustrated schematically and in perspective.

With reference to FIG. 1, numeral 1 indicates a packet, in its entirety, serving to contain loose items denoted P, preferably pastilles, sweets, candy or the like.

The packet 1, of which a full description is disclosed in application no PCT/IB2006/001635 for international patent, essentially comprises an outer casing 2 and an inner casing 3. The inner casing 3 is accommodated slidably within the outer casing 2, capable of movement thus between a first closed configuration and a second open configuration, and presents an opening 4.

In the closed configuration, the inner casing 3 is retracted into the outer casing 2 and the outer casing located over the opening 4, concealing it completely, whereas in the open configuration, the inner casing 3 is extended partially from the outer casing 2 with the opening 4 exposed at least in part, so that the contents P of the packet 1 can be dispensed.

In the example of FIGS. 1, 2, 3 and 4, the outer casing 2 appears as a right parallelepiped with a rectangular base, which presents a bottom 5, and a side wall 6 made up of two larger faces 6*a* and two smaller faces 6*b*.

The outer casing 2 presents an open end 7 opposite to the bottom 5 and serving to accommodate the inner casing 3, which appears likewise as a parallelepiped with a rectangular base, presenting a top 8 parallel to the bottom 5, and a side wall 9 made up of two larger faces 9*a* and two smaller faces 9*b*, breasted in contact respectively with the corresponding faces 6*a* and 6*b* of the outer casing.

The inner casing 3 fits only part of the way into the outer casing 2, even in the closed configuration, without reaching to the bottom 5. The two casings 2 and 3 combine to delimit an enclosure 10 of which the volume is variable according to the displacement of the casings 2 and 3 one relative to another, or in effect, to the distance between the bottom 5 and the top 8.

The enclosure 10 in question is accessible through the opening 4, which in the example illustrated is circular, cut into one smaller face 9*a* presented by the side wall 9 of the inner casing 3 and located near to the top 8. The inner casing 3 slides along the longitudinal axis X of the packet 1 between the retracted condition (FIG. 2), in which the top 8 lies flush with an edge 11 presented by the side wall 6 of the outer casing 2 and the opening 4 is breasted with one of the smaller faces 6*b* of the selfsame side wall 6, and the extended condition (FIG. 4), in which the opening 4 is located beyond the edge 11 and exposed.

The packet 1 further comprises stabilizing means, denoted 12 in their entirety, interposed between the outer casing 2 and the inner casing 3 and serving to secure the packet 1 so that it will neither open accidentally when not in use, nor close accidentally while the contents are being dispensed.

More exactly, the stabilizing means 12 comprise at least one connecting appendage 13 hinged to one face 6*a* of the side wall 6 presented by the outer casing 2 and to the corresponding face 9*a* of the side wall 9 presented by the inner casing 3, which is breasted in sliding contact with the aforementioned side wall 6 of the outer casing 2.

Figure 2:
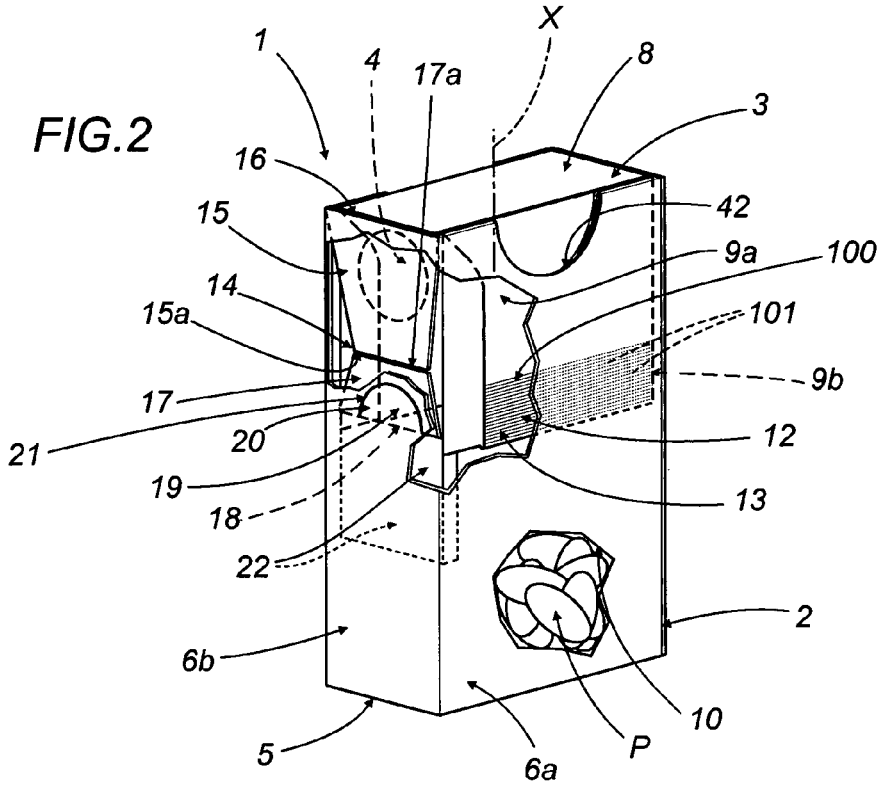
FIG. 2 shows the packet of FIG. 1, illustrated schematically and in perspective with certain parts omitted better to reveal others, viewed in a first operating position.
Figure 3:
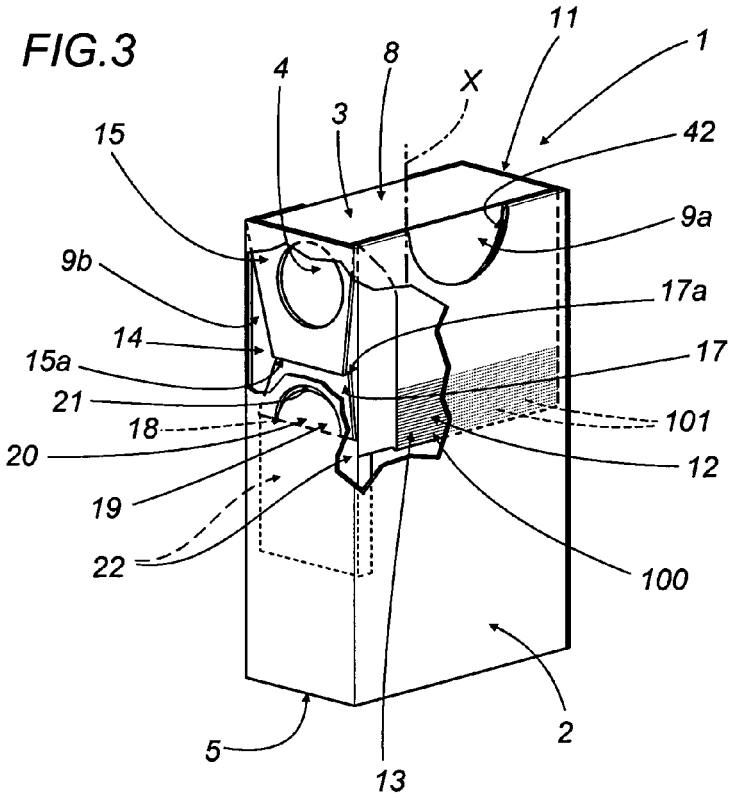
FIG. 3 shows the packet of FIG. 1, illustrated schematically and in perspective with certain parts omitted better to reveal others, viewed in a second operating position.
Figure 4:
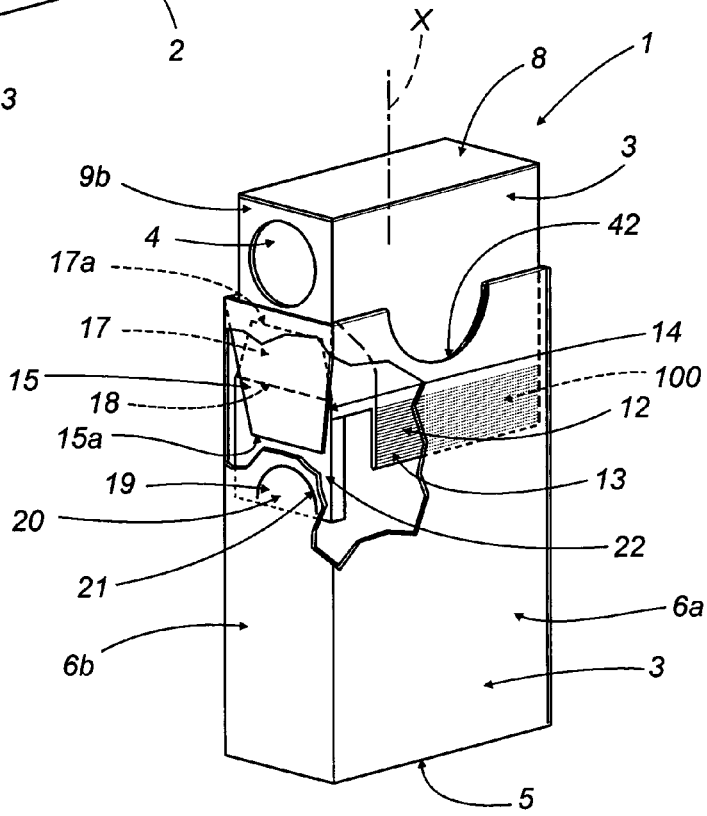
FIG. 4 shows the packet of FIG. 1, illustrated schematically and in perspective with certain parts omitted better to reveal others, viewed in a third operating position.

As illustrated in FIG. 2, the appendage 13 is incorporated by forming a plurality of ribs 100, hinged one to another along at least one auxiliary hinge line 101, such as will enable it to deform elastically when the inner casing is caused to slide against the outer casing.

Numeral 14 denotes locking means of which the function is to maintain the inner casing 3 in the closed position until such time as these same means 14 are operated from outside to release the packet from the closed position.

Such locking means 14 comprise a first tongue 15 extending from a top end of one smaller face 6*b* presented by the outer casing 2 and bent around a transverse fold line 16 until brought substantially into contact with the inside surface of the face 6*b*, with the free end directed toward the bottom 5 of the packet; also a second tongue 17 located on a smaller face 9*b* of the inner casing and bent around a transverse fold line 18 until brought substantially into contact with the inside surface of the face 9*b*, with the free end directed toward the free end of the first tongue 15.

The first and second tongues 15 and 17 are integral respectively with the outer casing 2 and with the inner casing 3, and designed to abut in contact one with another, end to end, when the inner casing 3 is in the closed configuration.

With the inner casing 3 in the closed position, more exactly, the respective free ends 15*a* and 17*a* of the tongues occupy substantially parallel planes, as discernible in FIG. 2.

The packet 1 further comprises an element 19 by means of which to release the locking means 14 and thus free the inner casing 3 from the aforementioned closed position.

The release element 19 comprises a tab 20 created by a cut 21 made in the same smaller face 6*b* of the outer casing 2 that presents the first tongue 15; in particular, the tab 20 lies positioned over the second tongue 17 when the inner casing 3 is in the closed position.

The tab 20 appears semicircular in the preferred embodiment of the accompanying drawings, but might be of any given shape.

The smaller face 9*b* of the inner casing 3 affording the second tongue 17 also presents an appendage 22 extending downward beyond the tongue 17.

When the inner casing 3 moves into the open position, the tab 20 is brought into alignment with the appendage 22, and thus prevented by the selfsame appendage from penetrating the space internally of the packet 1.

Figure 5:
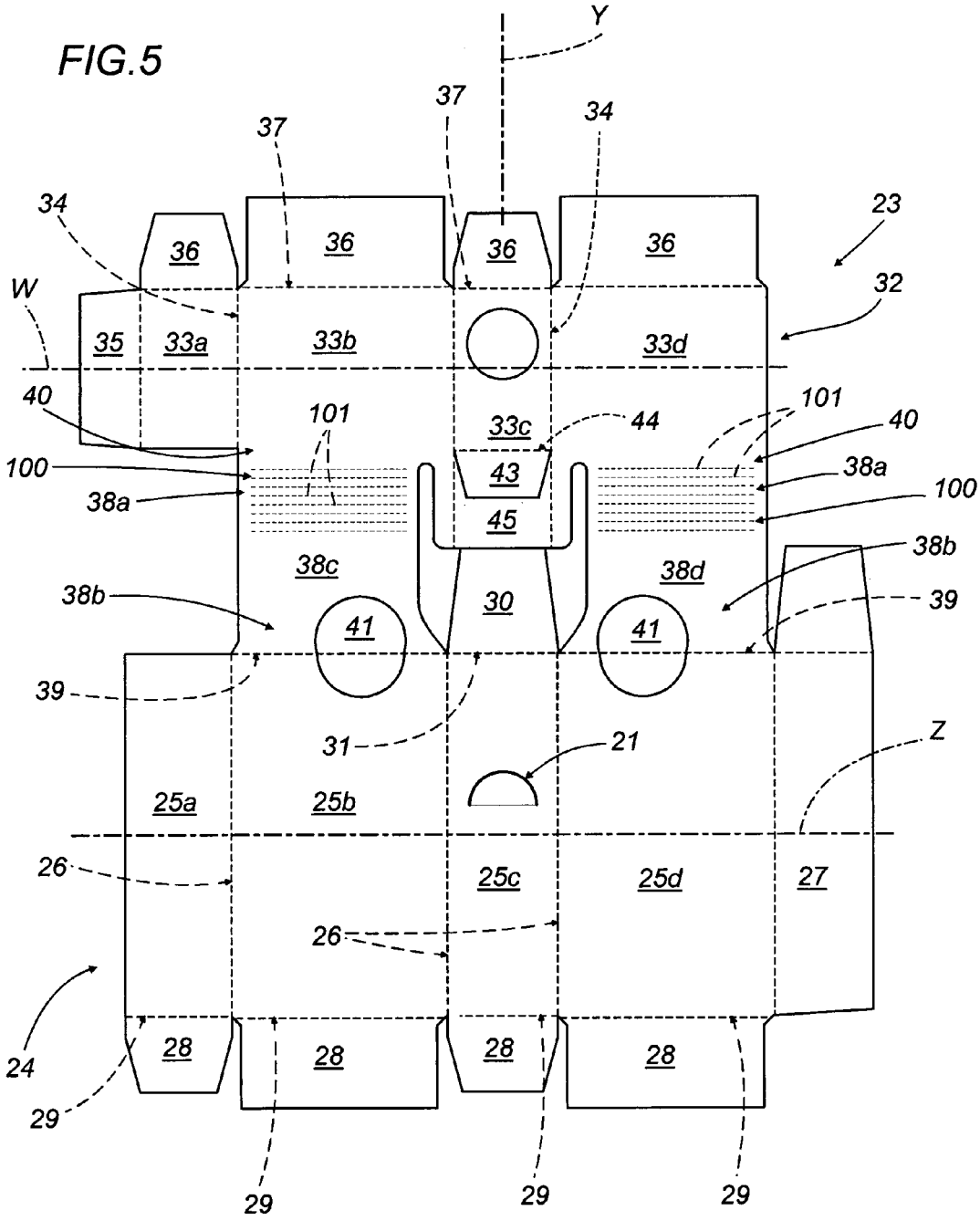
FIG. 5 shows a diecut blank from which to fashion a packet according to the present invention.

The packet 1 of FIGS. 1, 2, 3 and 4 is fashioned preferably from a flat diecut blank 23 of the type illustrated in FIG. 5, which is referable to a longitudinal axis denoted Y.

The blank 23 in question presents a main group 24 of panels 25 arranged side by side along a first transverse axis Z, separated one from another by respective longitudinal crease lines 26 and serving to form the side wall 6 of the outer casing 2 of the packet 1.

Referring in particular to FIG. 5, the main group 24 of panels comprises a first panel 25*a*, a second panel 25*b*, a third panel 25*c* and a fourth panel 25*d*, all rectangular, and a joint flap 27, ordered in sequence one beside the next along the transverse axis Z. The first and third panels 25*a* and 25*c* coincide with the smaller side faces 6*b* of the outer casing 2, whilst the second and fourth panels 25*b* and 25*d* coincide with the larger side faces 6*a* of the outer casing 2. When forming the packet 1, the joint flap 27 is united with and secured to the first panel 25*a*. Each of the four rectangular panels 25*a*, 25*b*, 25*c* and 25*d* also presents a closure flap 28, attached to the panel 25 along a respective transverse crease line 29 normal to the aforementioned longitudinal crease lines 26. The closure flaps 28 combine to form the bottom 5 of the packet 1.

The third panel 25*c* of the main group presents a first flap 30, joined to the selfsame panel along a transverse crease line 31 and coinciding with the aforementioned first tongue 15.

Also presented by the third panel 25*c* is the aforementioned cut 21 serving to create the release element 19.

Located at the end remote from the closure flaps 28, the blank 23 presents an auxiliary group 32 of panels 33 aligned on the longitudinal axis Y and ordered one beside the next along a second transverse axis W; the panels 33 are separated one from another by relative longitudinal crease lines 34 and make up the side wall 9 of the inner casing 3 of the packet 1.

Still referring to FIG. 5, the auxiliary group 32 of panels comprises a joint flap 35 of trapezoidal outline, also a first panel 33*a*, a second panel 33*b*, a third panel 33*c* and a fourth panel 33*d*, all rectangular, ordered in sequence one beside the next along the transverse axis W. The second panel 33*b* and the fourth panel 33*d* coincide with the larger faces 9*a* of the inner casing 3, whilst the first panel 33*a* and the third panel 33*c* coincide with the smaller faces 9*b* of the inner casing 3, the third panel 33*c* presenting the circular opening 4. When forming the packet 1, the joint flap 35 is united with and secured to the fourth panel 33*d*. Each of the four panels 33*a*, 33*b*, 33*c* and 33*d* also presents a closure flap 36, attached to the panel along a respective transverse crease line 37 normal to the longitudinal crease lines 34. The closure flaps 36 combine to form the top 8 of the packet 1.

The main group 24 of panels is attached to the auxiliary group 32 by way of connecting panels 38, each presenting a first end 38*a* joined to one of the panels 33 of the auxiliary group 32, and a second end 38*b* joined to one of the panels 25 of the main group 24 along a transverse crease line denoted 39.

In the example of FIG. 5, a first connecting panel 38*c* is located between the second panel 25*b* of the main group 24 and the second panel 33*b* of the auxiliary group 32, whilst a second connecting panel 38*d* is located between the fourth panel 25*d* of the main group 24 and the fourth panel 33*d* of the auxiliary group 32.

The first end 38*a* of each connecting panel 38*c* and 38*d* presents the aforementioned plurality of ribs 100, which extend parallel to the transverse crease lines 39 and delimit the relative connecting appendage 13.

In addition, the second and fourth panels 33*b* and 33*d* of the auxiliary group 32 are associated with the respective connecting panels 38 by way of a segment 40 that extends longitudinally beyond the adjoining first and third panels 33*a* and 33*c*.

The blank 23 presents an opening 41, for example of circular outline, located between each connecting panel 38 and the associated panel 25 of the main group 24 and providing the packet 1 with a thumb cut 42 in the edge 11 of the outer casing 2, such as will facilitate the action of gripping and pulling out the inner casing 3.

Referring to FIG. 5, the third panel 33*c* of the auxiliary group comprises a second flap 43 connected to the selfsame panel along a transverse crease line 44 and coinciding with the aforementioned second tongue 17.

Also forming part of the auxiliary group 32 is an extension 45 of the third panel 33*c*, projecting downward from the selfsame panel and coinciding with the second flap 43 such as will form the aforementioned appendage 22.

A packet according to the present invention is much easier and more convenient to use than packets of conventional design. Indeed, in the open configuration, there is no portion of the packet that will obstruct the passage of the contents when dispensed from the opening, and in the closed configuration, there is little chance of the packet being jolted open as a result of accidental impact With the adoption of the two tongues, in particular, which are disposed with the free ends abutting in mutual contact when the casings assume the closed configuration, the packet can be opened only when the tongues are disengaged manually one from another by pressing the semicircular tab to release the second tongue.

Accordingly, where the items contained in the packet are unsuitable for consumption by small children, the risk that a child might manage to open the packet easily and quickly can be avoided, given that such an action requires application of pressure to the semicircular tab in combination with a pulling force to extract the inner casing from the outer casing.

The invention claimed is:

1. A packet serving to contain loose items, comprising:

an outer casing, an inner casing having an opening, accommodated slidably within the outer casing and movable between a closed configuration, in which the opening is concealed completely by the outer casing, and an open configuration in which the opening is exposed at least in part, a locking mechanism for retaining the inner casing in the closed position, the locking mechanism being operable externally of the packet for releasing the inner casing from the closed configuration and allowing the inner casing to slide toward the open configuration;

the locking mechanism comprising a first tongue integral with and located internally of the outer casing, and a second tongue integral with and located externally of the inner casing, the first and second tongues being mutually abuttable in such a way as to prevent the inner casing from sliding in relation to the outer casing;

wherein the first tongue is attached to a side wall of the outer casing and folded double internally of the outer casing along a transverse crease line, and the second tongue is attached to a side wall of the inner casing and folded double externally of the inner casing along a transverse crease line.

2. A packet as in claim 1, comprising a stabilizing mechanism interposed between the outer casing and the inner casing to stabilize the inner casing in each of the two configurations.

3. A packet as in claim 1, comprising a release element located externally on a side wall of the outer casing for releasing the locking mechanism.

4. A packet as in claim 1, wherein the first tongue and the second tongue occupy two substantially parallel planes.

5. A packet as in claim 1, wherein the first tongue and the second tongue are disposed with respective free ends abutting in contact one with another when the inner casing assumes the closed configuration.

6. A packet as in claim 3, wherein the release element comprises a tab delimited by a cut made in the side wall of the outer casing and positioned over the second tongue at least in part when the inner casing is in the closed configuration, such that pressure applied to the tab is transmitted to the second tongue to release the inner casing from the closed configuration.

7. A packet as in claim 6, wherein the tab is semicircular.

8. A packet as in claim 2, wherein the stabilizing mechanism comprises at least one connecting appendage having a plurality of ribs hinged one to another along at least one auxiliary hinge line.

9. A packet as in claim 8, wherein the at least one connecting appendage is movable between a first position corresponding to the closed configuration, lying between the side walls of the two casings, and a second position corresponding to the open configuration, in which the appendage is rotated 180° from the closed position in such a way as will cause at least the side wall of the inner casing to flex elastically during movement between the first and second positions.

10. A blank from which to fashion a packet as in claim 1, comprising: a main group of panels ordered one beside the next along a first transverse axis (Z), separated by respective longitudinal crease lines and constituting the side wall of the outer casing or the inner casing of the packet; an auxiliary group of panels, distinct from the main group, ordered one beside the next along a second transverse axis (W), separated by respective longitudinal crease lines and constituting the side wall of the inner casing or the outer casing of the packet; at least one connecting panel associated with the main group of panels, presenting a first end joined to one of the panels of the auxiliary group and including at least one hinge line delimiting a connecting appendage, and a second end joined to one of the panels of the main group along a transverse crease line; a first flap joined to one of the panels of the main group along a transverse crease line; a second flap joined to one of the panels of the auxiliary group along a transverse crease line.

11. A blank as in claim 10, wherein the panel of the main group to which the first flap is joined includes a cut for forming a release element for releasing the locking mechanism.

12. A blank as in claim 11, wherein the cut is semicircular.

13. A blank as in claim 10, having at least one opening located between the connecting panel and the panel of the main group and providing the packet with a thumb cut such as will facilitate gripping of the inner casing.

14. A packet serving to contain loose items, comprising:

an outer casing, an inner casing having an opening, accommodated slidably within the outer casing and movable between a closed configuration, in which the opening is concealed completely by the outer casing, and an open configuration in which the opening is exposed at least in part, a locking mechanism for retaining the inner casing in the closed position, the locking mechanism being operable externally of the packet for releasing the inner casing from the closed configuration and allowing the inner casing to slide toward the open configuration;

the packet being formed from a blank comprising: a main group of panels ordered one beside the next along a first transverse axis (Z), separated by respective longitudinal crease lines and constituting the side wall of the outer casing or the inner casing of the packet; an auxiliary group of panels, distinct from the main group, ordered one beside the next along a second transverse axis (W), separated by respective longitudinal crease lines and constituting the side wall of the inner casing or the outer casing of the packet; at least one connecting panel associated with the main group of panels, presenting a first end joined to one of the panels of the auxiliary group and including at least one hinge line delimiting a connecting appendage, and a second end joined to one of the panels of the main group along a transverse crease line; a first flap joined to one of the panels of the main group along a transverse crease line; a second flap joined to one of the panels of the auxiliary group along a transverse crease line;

wherein the panel of the main group to which the first flap is joined includes a cut for forming a release element for releasing the locking mechanism.

15. A packet as in claim 14, wherein the cut is semicircular.

* * * * *